United States Patent [19]

Strattan et al.

[11] Patent Number: 4,795,871

[45] Date of Patent: Jan. 3, 1989

[54] METHOD AND APPARATUS FOR HEATING AND DRYING FABRICS IN A DRYING CHAMBER HAVING DRYNESS SENSING DEVICES

[75] Inventors: Robert D. Strattan; Mary E. O'Connor; James R. Sorem, Jr., all of Tulsa, Okla.

[73] Assignee: Micro Dry, Inc., Tulsa, Okla.

[21] Appl. No.: 92,621

[22] Filed: Sep. 3, 1987

Related U.S. Application Data

[63] Continuation-in-part of Ser. No. 920,605, Oct. 20, 1986.

[51] Int. Cl.[4] ..... H05B 6/64

[52] U.S. Cl. ..... 219/10.55 M; 219/10.55 A; 219/10.55 F; 219/10.57; 34/30; 34/39; 34/46

[58] Field of Search ..... 219/10.55 E, 10.55 F, 219/10.55 R, 10.55 A, 10.57; 34/30, 39, 46

[56] References Cited

U.S. PATENT DOCUMENTS

| | | | |
|---|---|---|---|
| 3,934,106 | 1/1976 | MacMaster et al. | 219/10.55 E |
| 4,006,338 | 1/1977 | Dehn | 219/10.55 F |
| 4,356,640 | 11/1982 | Jansson | 34/39 |
| 4,412,389 | 11/1983 | Kruger | 34/46 |
| 4,432,147 | 2/1984 | Chen et al. | 34/46 |
| 4,499,614 | 2/1985 | Yeagley | 34/46 |
| 4,558,523 | 12/1985 | Isbell et al. | 34/30 |
| 4,631,380 | 12/1986 | Tran | 219/10.55 A |
| 4,660,298 | 4/1987 | Nambu et al. | 34/30 |

*Primary Examiner*—Robert S. Macon
*Attorney, Agent, or Firm*—Robert S. Salzman

[57] ABSTRACT

The invention relates to a microwave heating and drying method and apparatus utilizing a multiplicity of microwave propagating sources positioned about a heating and drying chamber. The microwave energies are optimized to provide a greater uniformity in the heating and drying of articles disposed in the heating and drying chamber, while preventing interference of the wave propagations. The microwave pulses are cross-polarized and time-multiplexed. Also, the focusing and spread angles are controlled. The end point of the drying cycle is sensed to control microwave generation.

37 Claims, 7 Drawing Sheets

2 PORTS, RECTANGULAR ADJACENT SIDES

2 PORTS, RECT., OPPOSITE SIDES

2 PORTS, CIRCULAR, ADJACENT QUADRANTS

3 PORTS, CIRC.,

3 PORTS, RECTANGULAR

4 PORTS, RECT.,

6 PORTS, RECT.,

6 PORTS, CIRCULAR

2 MICROWAVE SOURCES 48;49
S=30° ANGULAR SPREAD
1 REFLECTION

2 MICROWAVE SOURCES 48;49
S=30° ANGULAR SPREAD
2 REFLECTIONS

2 MICROWAVE SOURCES 48;49
S=40° ANGULAR SPREAD
1 REFLECTION

METHOD AND APPARATUS FOR HEATING AND DRYING FABRICS IN A DRYING CHAMBER HAVING DRYNESS SENSING DEVICES

RELATED APPLICATION

This application is a continuation-in-part of the previously filed, and co-pending application, Ser. No. 920,605; filed: Oct. 20, 1986.

FIELD OF THE INVENTION

The invention relates to an improved method and apparatus for drying fabrics specifically fabrics and clothing by microwave energy, and more particularly to a process and devices for improving the heating and drying efficiency of a multiple microwave generating system for fabrics by focusing, cross polarizing, angularly orienting and time-multiplexing the microwaves, and efficiently sensing the dryness condition in the drying chamber of the system.

BACKGROUND OF THE INVENTION

The use of microwave energy to heat and cook comestibles has been an unqualified commercial success. Today, it is very hard to find an American home without a microwave oven.

As commonplace as the microwave oven has become, however, it is exceptionally surprising to observe the paucity of such heating devices for other household and industrial uses.

For example, as early as 1969, a method and apparatus was suggested for drying and sterilizing fabrics, as illustrated in U.S. Pat. No. 3,605,272, issued: Sept. 20, 1971.

The drying of wet fabrics should have become a commercial reality after fifteen years of research.

One of the drawbacks of perfecting a microwave clothes dryer has been the power requirements. Unlike a microwave oven, which requires a magnetron that generates 400 to 800 watts of microwave power, a typical clothes dryer needs a magnetron generating in excess of two kilowatts. A single magnetron generating this amount of power is very expensive.

Another possible problem with suggested microwave clothes dryer designs, is the inability to transfer and/or distribute the generated power uniformly to the wet fabric. Often hot spots develop in the fabric mass. Such hot spots can cause scorching of the fabric, and are a fire safety concern.

To the best of our knowledge, it never has been suggested that more than one magnetron be utilized to improve heating and drying uniformity. Using two or more magnetrons would solve the first aforementioned problem, wherein several low cost magnetrons could efficiently replace one expensive unit.

However, a clothes dryer with two or more magnetrons would not necessarily be more efficient in the transfer or distribution of the microwave energies. Magnetrons whose generated waves share the same plane of propagation will interfere with each other. Also, unabsorbed power that reflects off the heating chamber walls can enter the wave guide of an adjacent magnetron through its antenna and alter its operation and efficiency.

Another complex problem arises in sensing the dry condition of fabric in a heating chamber having multiple magnetrons. In the past, the dry condition was sensed by the pattern of microwave reflections from a single generator within the drying chamber. Such a sensing system is illustrated in prior U.S. Pat. Nos. 3,290,587; issued Dec. 6, 1966; 3,439,431; issued: April 22, 1969; and 3,192,642; issued: July 6, 1965.

The above sensing techniques presented a fairly uncomplicated approach to the problem of determining the dry condition, mainly because the reflective pattern of a single magnetron or other stand alone microwave generator was easily determinable.

However, with the need for a multiplicity of magnetrons spread in different planes about the drying chamber of the present invention, the pattern of wave reflection is more complicated.

The sensing of the dry condition in the fabric is easily determined by the present invention using but not limited to any or all of the following methods:

1. After continuously measuring relative humidity determining when the chamber outlet relative humidity returns to within approximately 6% above the inlet relative humidity reading.

2. After continuously measuring absolute humidity in the exhaust determining when the absolute humidity output (measured in millivolts) reaches approximately 1 mv above a baseline reading chosen at the beginning of the drying run.

3. Sensing when the chamber exhaust temperature which is continuously measured, shows a sharp increase.

4. Sensing a sharp or sudden increase in continuously measured anode temperature of each magnetron in the chamber.

Each magnetron anode temperature can be used for end point determination of the drying process. However, each magnetron anode temperature sensor can be considered as a potential sensor for a power management scheme in the microwave dryer as well as a method of determining the drying end point. Power management may lead to significant improvements in power efficiency and magnetron life expectancy.

BRIEF SUMMARY OF THE INVENTION

The invention features a method and apparatus for improving the uniformity of heating and drying fabrics being heated by microwaves within a heating chamber. The microwaves are directed into the heating chamber in a substantially non-interfering manner from at least two positions disposed about the heating chamber. Anywhere from between two and six magnetrons can be used for this purpose. The microwaves from at least two positions are cross-polarized or oriented perpendicularly with respect to each other to prevent or minimize interference between them.

The possibility of interference is further reduced by independently time-multiplexing the generation of the microwaves at each position. Thus, simultaneous heating from two or more generating sources will not occur.

The articles are additionally heated in a uniform manner by angularly focusing the directed microwaves, i.e. the directed angle between certain ones of the microwave generators is less than 90 degrees. The angular focusing of the magnetrons can be accomplished by shaping the heating chamber end plates in a frustroconical or pyramidal fashion, i.e. the walls defining a portion of the heating chamber are obliquely angled to form conical or pyramidal shapes. The magnetrons positioned upon these obliquely angled chamber portions will, as a consequence, direct the generated microwaves into the chamber at an angle of less than 90 degrees between them.

The uniformity of the heating within the chamber is also controlled by varying the angular spread of the microwaves. The spread of the microwaves at each magnetron is controlled between 30 and 40 degrees.

The drying end point must be accurately determined not only to prevent scorching of the fabric within the drying chamber, but also to make efficient use of magnetron power. Toward the end of the heating and drying cycle, the temperature of each magnetron anode will begin to rise. The higher temperatures indicate that the power outputs are not being absorbed by the fabric, but are being reflected back into the wave-guides where they are dissipated as heat.

Careful monitoring of the dryness condition therefore can also provide appropriate power management.

Because both size and wetness of the fabric load influences the amount of reflected power, it is very important to monitor anode temperatures either to determine the dryness end point or as a means to control the power generated by the magnetrons. In other words, the changes in reflected energies to each magnetron may be sensed in order to reduce magnetron output, and to terminate the heating cycle.

The reduction of magnetron power can be matched with the load conditions, wherein there may be a gradual decrease of output power as the dry condition is achieved. Such power management, or power deceleration, would not only provide a more efficient use of energy, but would also extend the useful operating life of each magnetron.

Each of the multiple magnetrons may experience a different reflective loading depending upon its spacial relationship or position with respect to the load.

It is an object of this invention to provide an improved method and apparatus for heating and drying fabric by microwave energy utilizing multiple microwave sources.

It is another object of the invention to provide a method and apparatus for heating and drying fabric by multiple magnetrons in a more uniform manner, and generally without causing interference between the generated waves or the operation of the magnetrons.

It is a further object of this invention to provide a more efficient and efficacious method and apparatus for the drying of wet fabric and clothing articles by microwave energy, wherein the power output of the microwave source can be controlled as a function of reflected or unabsorbed energy.

These and other objects of the invention will become more apparent and will be better understood by subsequent reference to the detailed description considered in conjunction with the accompanying drawings.

BRIEF DESCRIPTION OF THE DRAWINGS

FIG. 10*aa* depicts the diagrammatic cross-sectional view of FIG. 10*a*, with a double reflection of the microwave propagation.

DETAILED DESCRIPTION OF THE INVENTION

Generally speaking, the invention pertains to a method and apparatus for heating and drying one or more articles, particularly moist fabrics, in a microwave heating and drying chamber. The invention utilizes a plurality of microwave sources in order to more uniformly distribute and propagate the microwave energies. The chamber and microwave port configurations are designed to prevent, or at least minimize, interference between the microwaves and microwave source operation, while more uniformly focusing and spreading the microwave energy. The invention accomplishes the above objectives by providing at least one or all of the following techniques:

a. focusing the microwave energy into the heating chamber.

b. cross-polarizing the multiple source microwave propagations.

c. angularly orienting or spreading the microwave propagations to densify the energy propagated into the heated articles disposed in the chamber.

d. time-multiplexing, or independently pulsing each microwave generator to prevent operational interference therebetween.

The dry condition is determined, but not limited to any or all of the following methods:

1. After continuously measuring relative humidity determining when the chamber outlet relative humidity returns to within approximately 6% above the inlet relative humidity reading.

2. After continuously measuring absolute humidity in the exhaust determining when the absolute humidity output (measured in millivolts) reaches approximately 1 mv above a baseline reading chosen at the beginning of the drying run.

3. Sensing when the chamber exhaust temperature which is continuously measured, shows a sharp increase.

4. Sensing a sharp or sudden increase in continuously measured anode temperature of each magnetron in the chamber.

Each magnetron anode temperature can be used for end point determination of the drying process. However, each magnetron anode temperature sensor can be considered as a potential sensor for a power management scheme in the microwave dryer as well as a method of determining the drying end point. Power management may lead to significant improvements in power efficiency and magnetron life expectancy.

Figure 1:
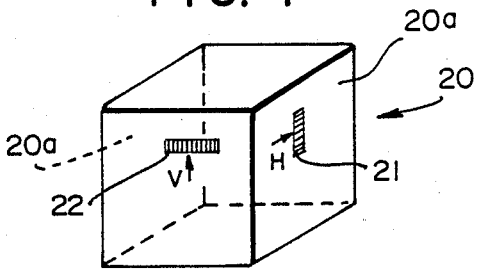
FIGS. 1 through 8 are perspective, schematic views of eight embodiments of the invention, illustrating various heating chamber configurations, each of which depict different magnetron port placements about the respective chambers.
Figure 1A:
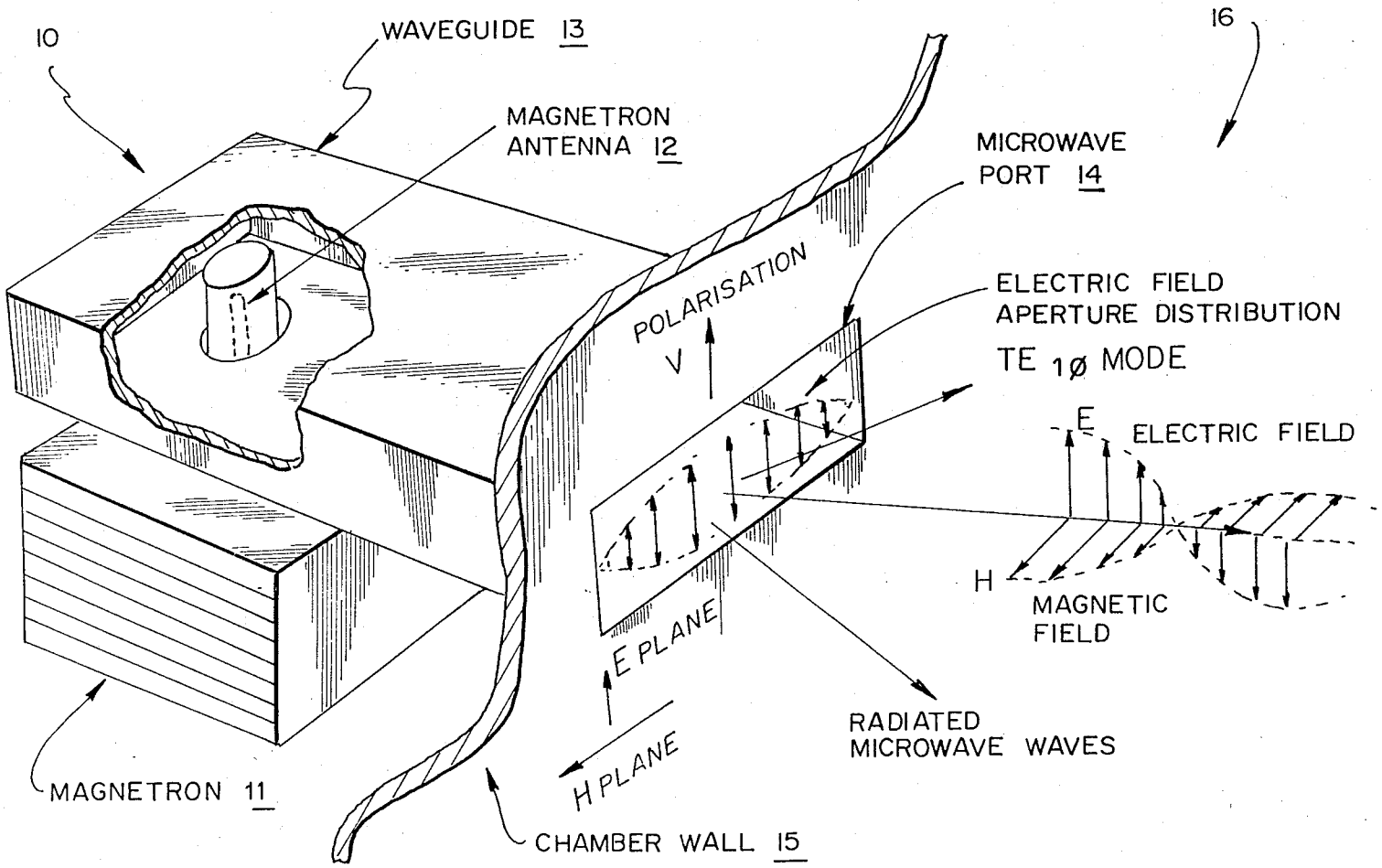
FIG. 1*a* is a perspective diagrammatic view of a microwave source illustrating the field polarization of the microwaves.

Now referring to FIG. 1*a*, a schematic of one of several typical microwave sources 10, such as a magnetron 11 antenna 12 and wave guide 13 is shown propagating the generated microwaves through a port 14 disposed in a wall 15 of a heating chamber cavity defined by arrow 16. The moist fabrics or clothing articles (not shown) are heated and tumbled within the heating chamber cavity 16, in order to remove the moisture and dry the fabrics.

The microwave power injected into the chamber interacts with the water molecules in the wet fabric. The microwave power is converted to heat, providing the heat of vaporization required for the transition of the water from liquid to gas. Once in the gaseous state, the water vapor is transported out of the chamber by an air stream (not shown). Pre-heating the air stream with waste heat from the magnetrons improves the efficiency of the evaporation process, as does the tumbling action.

The microwaves will heat the fabric in the chamber in proportion to the mass of the material and electromagnetic loss factor. Non-uniform heating of the fabric can cause hot spots, with the possibility of scorching and ignition of the fabric. Thus, the invention has as one of its purposes to more uniformly inject and distribute the microwave energy into the chamber cavity 16.

The location and orientation of the multiple ports 14 and microwave sources 10 feeding powe into the drying chamber cavity 16 must be properly chosen to provide uniform and efficient power transfer to the wet fabric. The use of multiple sources 10 provides a uniform density and distribution of power. Additionally, such multiple microwave sources can utilize readily-available, low-cost magnetron tubes and power supplies produced for microwave ovens. It is desirable to feed the microwave power into the chamber cavity 16 from more than one port 14 to assure a uniform heating rate throughout the volume of the clothes to be dried. Multiple ports 14 facilitate the use of multiple magnetrons 11 or other microwave generating devices. Using only one source to provide the necessary two or more kilowatts of microwave power would require expensive industrial magnetron tubes or other microwave sources not readily available from suppliers. Magnetrons manufactured for microwave ovens typically produce 400 to 800 watts of microwave power each. A typical domestic clothes dryer would require 2 to 6 of these magnetron tubes.

In addition to locating the multiple ports 14 on chamber walls 15 in positions that ensure uniform illumination of the wet fabric load, the polarization orientation of the microwave ports 14 is important. The polarization of the microwave radiation must be crossed, or oriented perpendicularly, between ports that are co-aligned. This cross-polarizing minimizes the coupling between ports 14 to ensure more efficient operation and generation of microwave power over a wide range of loading conditions.

As shown in FIG. 1*a* a typical microwave power source 10 has port 14 opening into the chamber 16, to provide the resulting electromagnetic fields. The polarization is designated as the spacial orientation of the electric field directions with the E-plane vertical. The magnetron 11 couples the microwave power into the waveguide 13 through an antenna 12 that protrudes through the broad wall, or H-plane, of the waveguide 13. The E- and H-plane refer to the forced spacial orientations of the electric (E) and magnetic (H) field components of the $TE_{10}$ electromagnetic wave propagation mode that exists in the rectangular waveguide 13. A WR-284 size waveguide operating at 2.45 Hz ensures that only the $TE_{10}$ mode will transport power to the port 14. The electric field will be oriented in a plane parallel to the magnetron antenna and perpendicular to the broad wall, or in the E-plane. The E-plane is vertical in the illustration of FIG. 1*a*. For the purposes of this description this is a vertical polarization orientation. Obviously, other orientations are possible within the scope and limits of the invention.

While the electric field varies in intensity across the aperture of port 14 into the chamber cavity 16, its polarization remains vertical. The resulting radiated field will have the same field orientation or polarization. The radiated waves will propagate outwardly in all directions in the hemisphere, but will have the greatest intensity along the axis of the waveguide and perpendicular to the chamber wall 15.

Most of the radiated microwave power will be absorbed by the clothes in the central part of the chamber cavity 16. The unabsorbed power will reflect from the walls 15 of the chamber or be coupled into the ports 14 of the other microwave sources 10. The unabsorbed power that enters the waveguide 13 can interact with the magnetron 11 through its antenna 12 and alter its electromagnetic operating environment and efficiency. The orientation of the ports 14 such that those with the largest potential for coupling have their polarizations crossed, minimizes the possibility of power from one source interfering with the operation of another source. Various embodiments of the invention are shown in FIGS. 1 through 8. Polarization is indicated as H (horizontal) and V (vertical).

Referring to the various embodiments of FIGS. 1 through 8, like elements or components will have the same designation. In FIG. 1, a rectangular heating chamber 20 has two microwave ports 21 and 22, respectively. They are located on adjacent sides of the rectangular chamber 20 to minimize directional coupling and the ports 21 and 22 are cross-polarized to further reduce coupling between the microwave fields.

Figure 2:
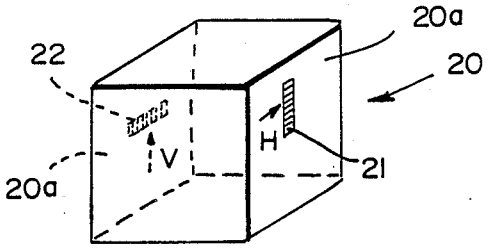

FIG. 2 shows a double port rectangular chamber 20, similar to FIG. 1, where the ports 21 and 22, respectively, are on opposite sides of chamber 20 and the reduction of port to port coupling depends entirely upon the cross-polarization of the ports 21 and 22.

Figure 3:
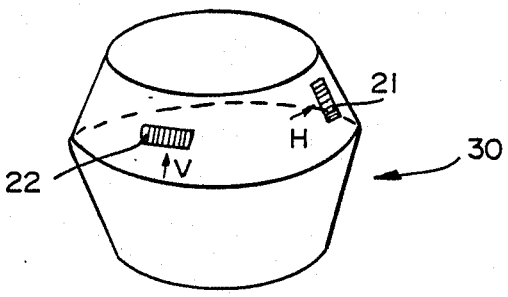

FIG. 3 shows the two ports 21 and 22 in adjacent quadrants, with a cross-polarized port arrangement wherein ports 21 and 22 are disposed about a frustro-conical circular chamber 30.

Figure 4:
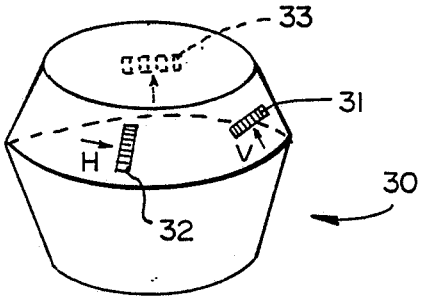

FIG. 4 shows three ports, 31, 32 and 33, respectively, arranged about the circular frustro-conical chamber 30. The ports 31, 32 and 33 are cross-polarized to decouple the diametrically opposed ports.

Figure 5:
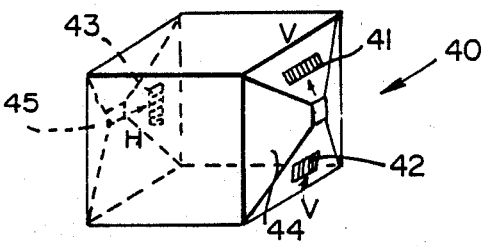
Figure 6:
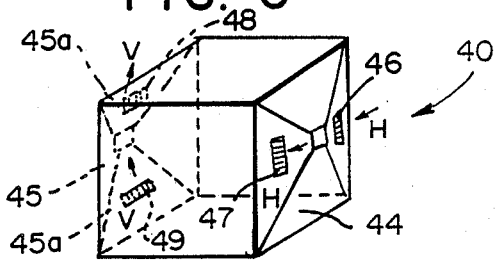

FIG. 5 shows three ports, 41, 42 and 43, respectively, disposed about rectangular chamber 40. Chamber 40 has pyramidal ends 44 and 45 respectively. The ports 41 and 42 on end 44 are cross-polarized with port 43 on end 45 to minimize coupling. The pyramidal ends 44 and 45 aid in redirecting the microwave reflections so that coupling between co-polarized ports 41 and 42 on the same end 44 is minimized. The same concept as shown in FIG. 5 is extended in FIGS. 6 and 7, to accommodate 4 and 6 ports, respectively. The arrangement shown in FIG. 6 is the preferred embodiment. This arrangement is also obviously adaptable to 5, 7 and 8 ports.

The chamber 40 in FIG. 6 has similar pyramidal ends 44 and 45 to focus or angle the pairs of cross-polarized ports 46 and 47; and ports 48 and 49. This focusing which redirects the reflections of the microwaves will be better explained hereinafter, with reference to FIGS. 10*a*, 10*aa* and 10*b*.

Figure 7:
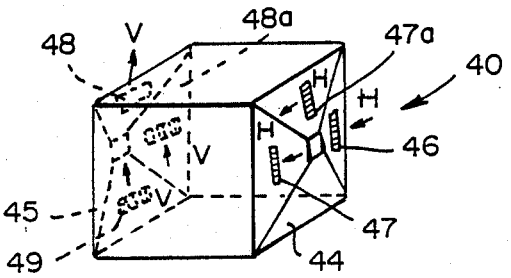

FIG. 7 depicts chamber 40 having a group of 3 ports 46, 47 and 47*a* on pyramidal end 44 which are cross-polarized with a group of 3 ports 48, 48*a* and 49 disposed upon pyramidal end 45.

Figure 8:
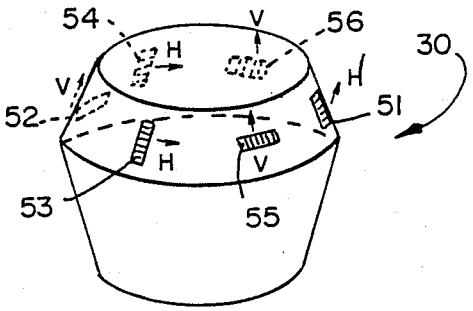

A six port circular frustro-conical arrangement is shown in FIG. 8. The diametrically opposite ports 51 and 52 disposed on chamber 30 are cross-polarized, as are the adjacent pairs of ports 53 and 54; 55 and 56. This minimizes the port to port coupling. Similar arrangements can be developed for other chamber shapes and number of ports following these basic guidelines, in accordance with the teachings of this invention.

Figure 9:
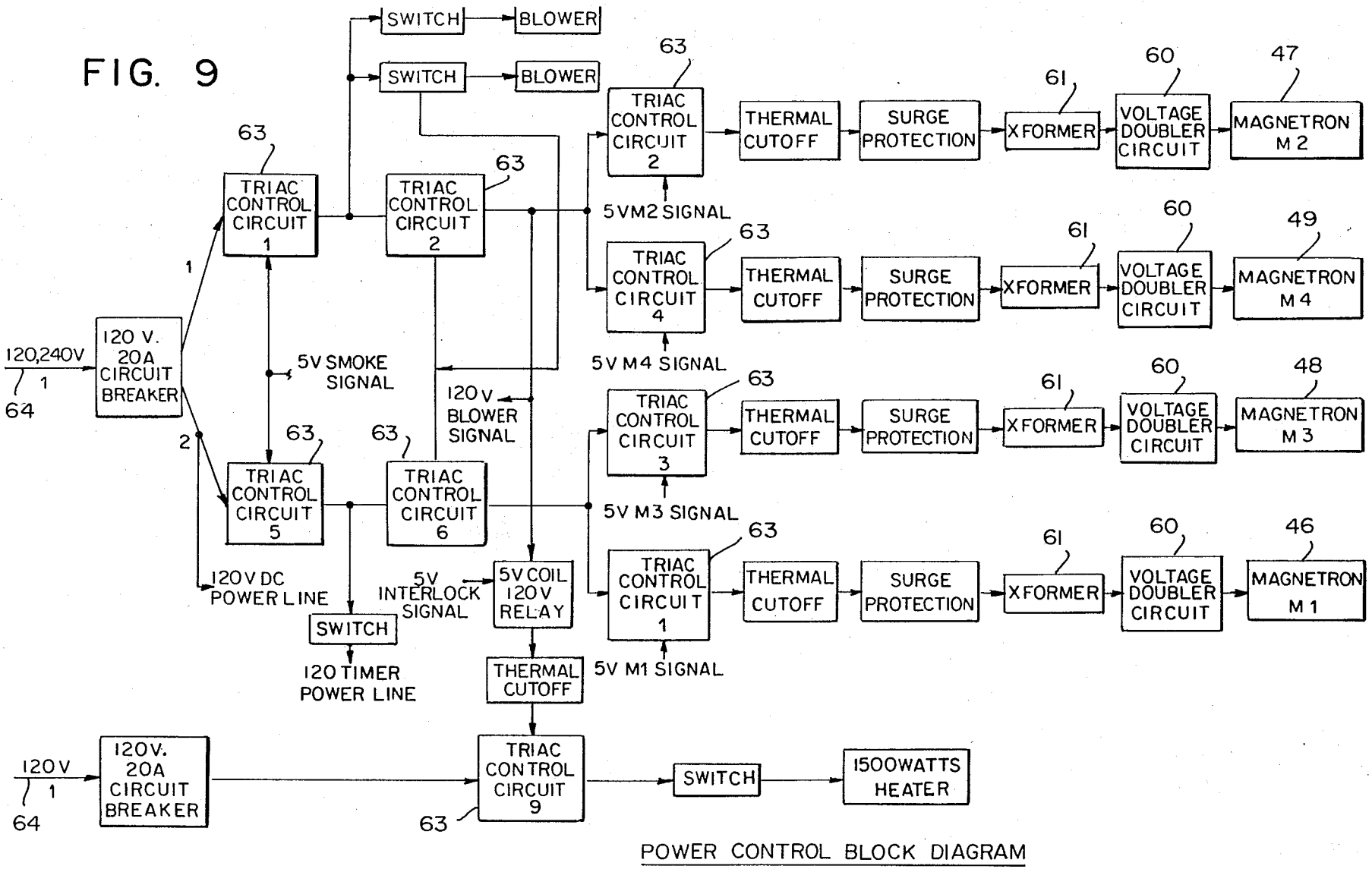
FIG. 9 is a schematic block diagram of a typical circuit for controlling and energizing a microwave heating chamber having four magnetrons.

Referring now to FIG. 9, a power circuit is shown for a chamber configuration having four magnetrons, such as the chamber 40 of FIG. 6.

Additional isolation of the coupling between magnetron sources 46; 47 and 48; 49 is provided by the time multiplexing of the pulsed microwave power output of the magnetrons. A voltage doubler circuit 60 for each magnetron is used to provide the high voltage electrical power to the magnetrons from a 60 Hz power line 64. The nature of this circuit and the magnetrons is that a pulse or burst of microwave power is produced for a few milliseconds of the 1/60 second period of the input power waveform. By using the two opposing phases of the 120/240 volt power source, or by alternating the polarities of transformers 61, the time periods of microwave power production of adjacent magnetrons can be offset so that simultaneous power production does not occur. This further reduces the coupling effects between multiple sources.

The flow of power from the 120/240 volt 60 Hz supply line 64 through the various control circuits to the four magnetrons 46; 47; 48 and 49, the blower and heater controls, and various smoke, heat and humidity sensors, is shown. The triac circuits 63 provide on or off switching of the a.c. power based upon proper control signal status. The power is fed to transformers 61 and diode/capacitor voltage doubler circuits 60 that provide a pulse of high voltage direct current power to the magnetrons 46; 47; 48 and 49 producing a pulse of microwave power.

Humidity and temperature sensor circuit outputs are compared to reference thresholds. The logical outputs of these threshold comparisons are combined, along with the conditions of other inputs such as door-closed interlocks on chamber 40 and a timer clock. If all conditions are met, including other controls such as smoke free air stream and blower-on condition, power is applied to the magnetrons. If all conditions are not met the magnetron power will be interrupted. Some examples of interrupt conditions include low humidity, high temperature, door open, etc. A removable tumbler interrupt signal, if the tumbler is not in place, may also be included.

Optimum tumbler design would probably be a cylindrical container with 3 to 5 ribs. In the current design, maximization of air flow through the tumbler is attempted by: (1) forcing the air into one end of the tumbler with a deflector, and (2) not providing openings in the tumbler other than at the two ends. The inlet and outlet ducts were placed on opposite ends of the container to optimize cross-flow air.

Figure 10A:
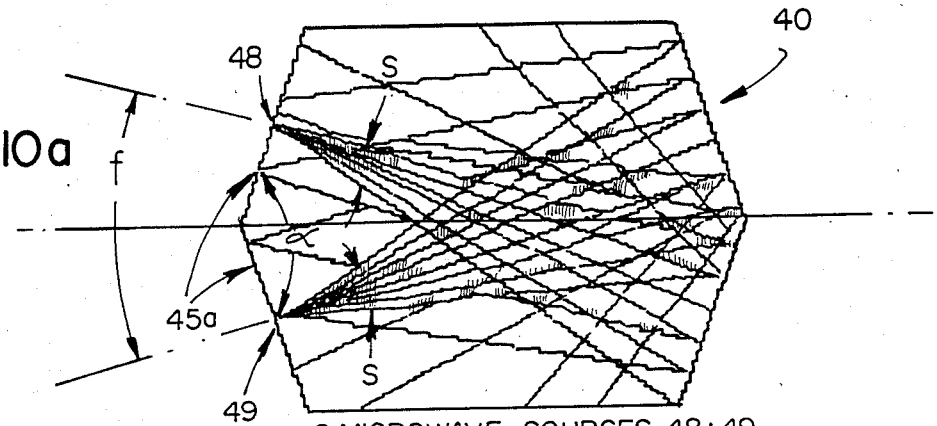
FIG. 10*a* is a diagrammatic cross-sectional view of a single reflection of a microwave propagation for the heating chamber configuration and port placement embodiment shown in FIG. 6, depicting an angular focusing of both microwave fields of less than 90 degrees there between, and an angular spread of 30 degrees for each wave propagation.
Figure 10A:
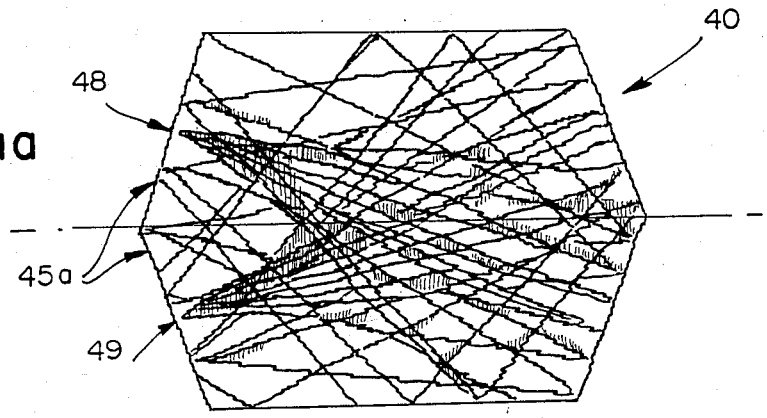

The decision regarding the shape of the chamber 40 was made following the decision to use between 2 and 6 magnetrons. A software program operating on a PC computer was written to provide a visual model of chamber 40 and to simulate the reflection of microwave radiation in the container. The program allowed for variation in the shape of chamber 40, the angular spread of the microwave signal, and the number of reflections. This program presented a strictly two dimensional model of the contained area. The reflection patterns as shown in FIGS. 10*a*; 10*aa* and 10*b* were compared with regard to apparent production of hot and cold spots in various configurations. The chamber 40 was fabricated with flat plate to increase angular reflections of the microwaves. Instead of placing flat end caps 20*a* on chamber 20 shown in FIGS. 1 and 2, four sided pyramids 44 and 45 were used as shown for chamber 40 of FIGS. 5 and 6 and 7. The pyramidal shape when combined with the cross-polarization of the magnetrons on opposite ends reduces likelihood of magnetron coupling.

Figure 10B:
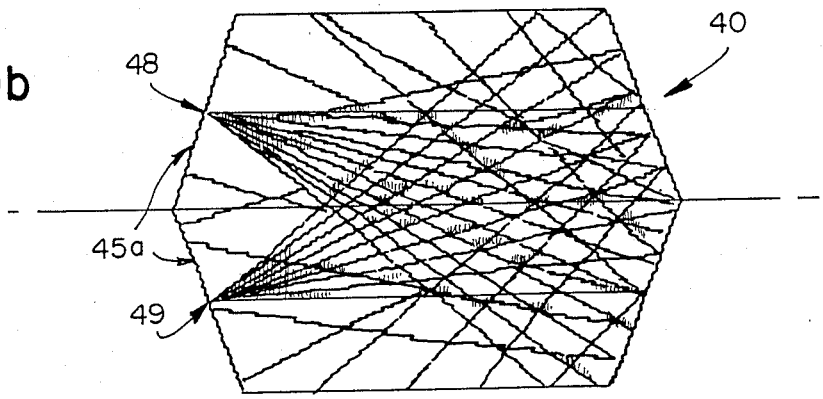
FIG. 10*b* illustrates the diagrammatic, cross-sectional view of FIG. 10*a*, with an angular spread of 40 degrees for each wave propagation.

FIG. 10*a* depicts magnetrons 48 and 49 propagating microwaves into chamber 40 of FIG. 6 at an angle "f" of less than 90 degrees between them. The angle "f" is a consequence of the pyramidal angle " " between the end plates 45*a*. The angle "f" of the microwave pulses illustrates how the microwave energy can be focused into the center of the chamber 40 where the tumbling fabrics are more likely to absorb the microwave energy. The angular spread "s" of 30 degrees as shown in FIGS. 10*a* and 10*aa*; or 40 degrees as shown in FIG. 10*b*, illustrates that the densification and the reflection of the microwaves can be controlled, as well as the focusing angle "f", in order to provide optimum heating conditions.

The microwave drying process requires the sensing of the dry condition in order to terminate the application of microwave power to prevent the scorching or ignition of the dry fabric. As long as the fabric is wet, the water molecules absorb the microwave power, converting the absorbed power to latent heat of evaporation. Once the water is totally evaporated, the microwave power heats the fabric at a very rapid rate and may scorch or burn the fabric if the process is not terminated.

While the water is present in the fabric, a very high fraction of the incident microwave power is absorbed and almost none is reflected. This results in a small relection coefficient at the cavity port and a high degree of coupling of the power from the magnetron to the wet fabric load. The evaporated water vapor is carried out of the exhaust port in an air stream heavily laden with water, exhibiting a high absolute humidity.

As the fabric approaches the dry condition, the microwave absorbed power results in a temperature rise of the fabric since there is no more water to evaporate. The amount of water in the exhaust stream decreases, reducing the absolute humidity. The microwave reflection properties of the fabric change as the water leaves, resulting in a poorer coupling and more reflection of the microwave power. This results in an increased reflection coefficient at the cavity port.

It is essential to detect this dry or near dry condition to terminate the process. Continued operation of the magnetron microwave sources will overheat the fabric causing damage and perhaps a fire. The operation of the magnetrons into a poorly matched load results in large reflection, increasing the amount of heat that the magnetron anode cooling system must carry off. This increased heating load increases the magnetron anode temperature resulting in possible damage to the magnetron and a shortened operational lifetime.

Figure 12:
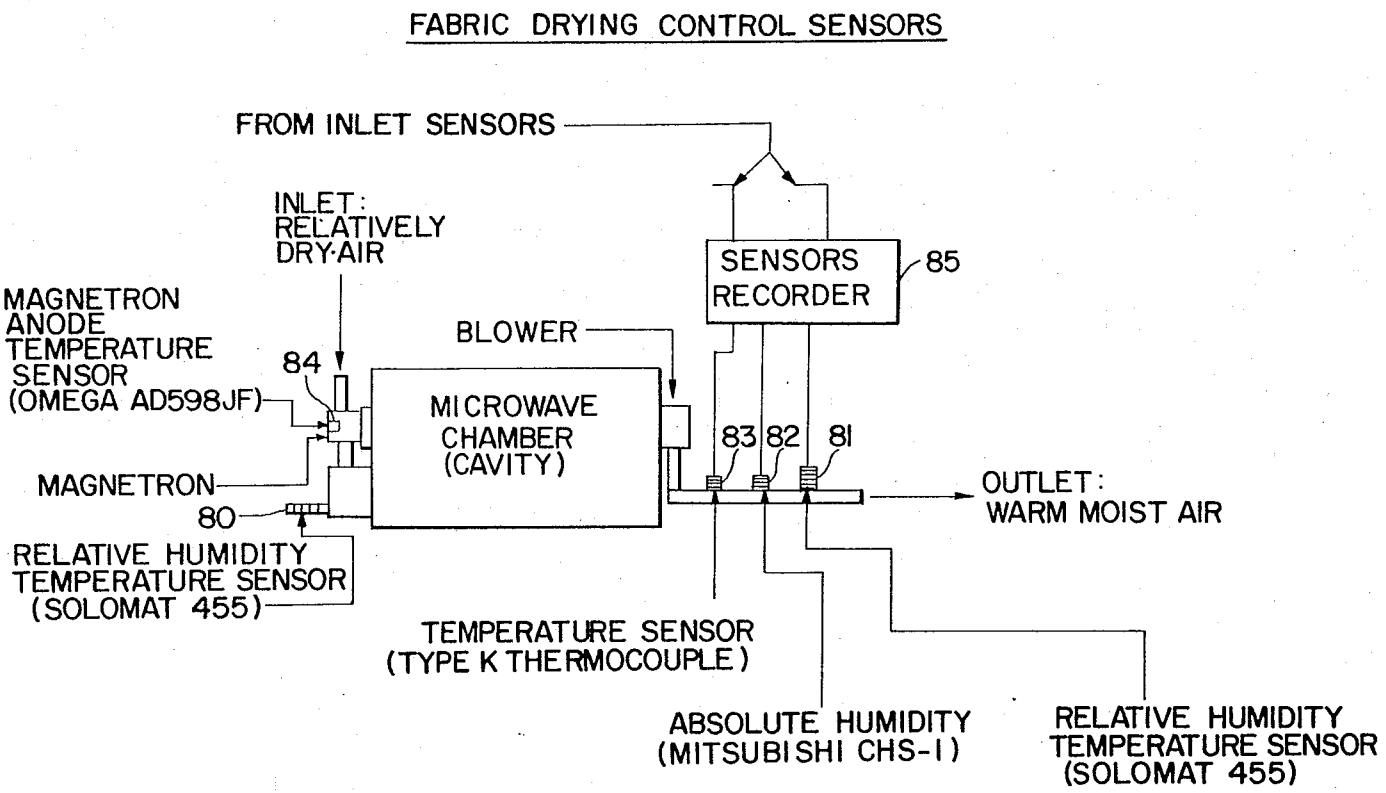
FIG. 12 depicts a schematic block diagram of the fabric drying control sensors used with one of the drying chambers of FIGS. 1 through 8.

The end point of the fabric drying process in the prototype microwave dryer is determined by looking at the output of various sensors monitoring the drying process. The major parameters monitored drying the drying process are temperature and humidity of the inlet and outlet air. In addition, the magnetron anode temperature is also monitored, referring to FIG. 12, a schematic block diagram is shown of the sensors and the drying chamber of FIGS. 1 through 8. The inlet temperature and relative humidity are monitored by the digital thermohygrometer 80 (SOLOMAT 455). The second digital thermohygrometer 81 (SOLOMAT 455) is used to monitor the outlet temperature and relative humidity. In addition an absolute humidity sensor 82 (Mitsubishi CHS-1) and a type K thermocouple 83 are used, respectively, to measure the absolute humidity and temperature at the outlet. The temperature of one of the magnetrons is also measured by a solid state temperature sensor 84 (OMEGA AD590J). A three-channel chart recorder 85 is used to record the magnetron temperature, the inlet temperature, and the absolute humidity. In addition, a microcomputer controlled data acquisition system (not shown) is used to record output signals of all the sensors.

Figure 13:
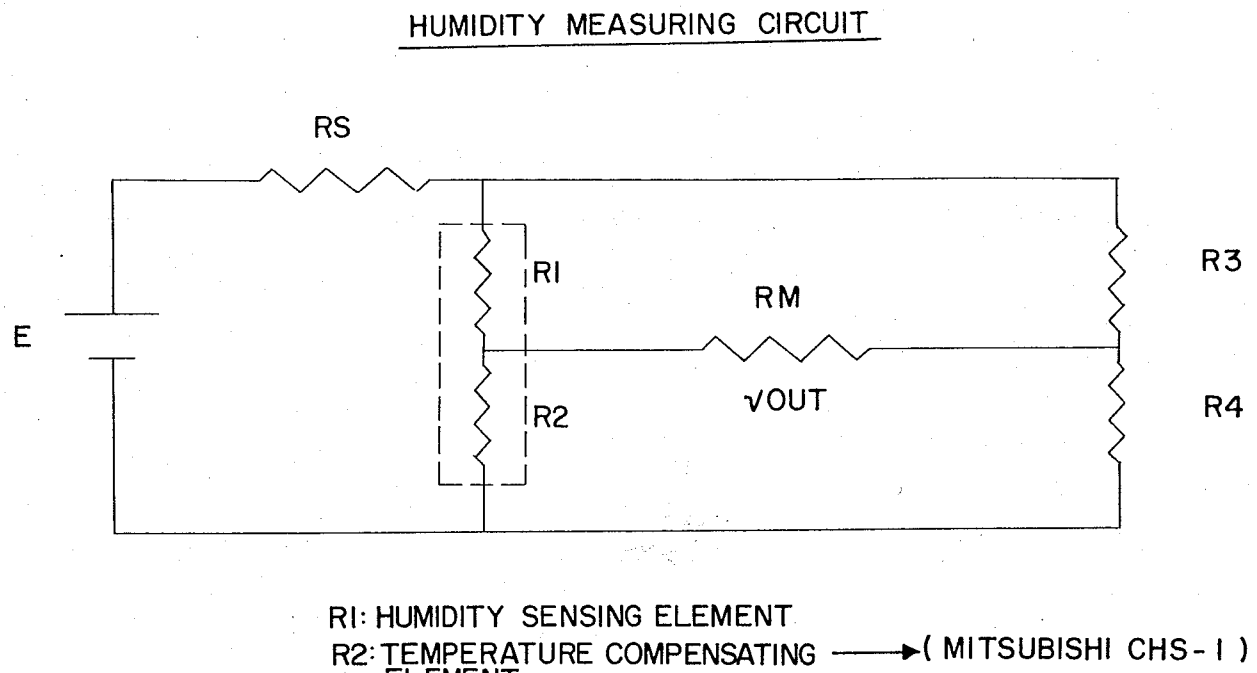
FIG. 13 illustrates a schematic circuit diagram of one humidity sensor of FIG. 12.

The absolute humidity sensor 82, model CHS-1 is manufactured by Mitsubishi. It is calibrated to measure the density of air in terms of millivolts output (0–10 mv). The sensor 82, as shown in FIG. 13, consists of two thermistors R1 and R2, and resistors R3 and R4 forming a bridge network. Thermistor R1 is used as a humidity sensing element, while thermistor R2 is used as the temperature-compensating element. Thermistor R1 is exposed directly to the atmosphere, while the thermistor R2 is enclosed in a dry sealed air chamber.

Thermistor R1 responds to changes in air properties during humidity measurement. The bridge network voltage balance changes due to the change in the resistance of thermistor R1 producing a varying voltage output across resistor RM. The output voltage produced is calibrated to measure the density of the air which is related to the absolute humidity. A set of calibration curves for the output under different ambient temperature conditions is used to correct the output for actual operating temperature condition. The absolute humidity sensor 82 may be used to determine the end point of the drying process. The chosen criteria for dryer shutdown, based on experience, is when endpoint voltage is approximately 1 mv above the baseline which was chosen at the beginning of the run.

The digital hygrometers 80 and 81, model 455 is manufactured by Solomat. It has a 4 digit display and an analog output. The instrument can measure from 0% to 100% relative humidity and −190° F. to 199° F. The temperature sensor used is a Pt. 100 RTD (platinum 100 ohm resistance temperature detector). The humidity sensor used is a thin film of dielectric material which rapidly absorbs and desorbs water, changing its capacitance in response to relative humidity. This sensor type is located on both the inlet and outlet air ducts. The end point of the drying process occurs when the outlet relative humidity is within approximately 6% above the inlet relative humidity when observing the sensor displays. Further analysis has shown that the true end point occurs when the outlet relative humidity minus the inlet relative humidity equals the initial offset.

The solid state temperature sensor 84, model AD590JF is manufactured by Omega. This sensor uses a fundamental property of the silicon transistors where resistance changes with temperature to provide an output signal proportional to temperature. The sensor is calibrated to output 1 mv per degree K.

Figure 11:
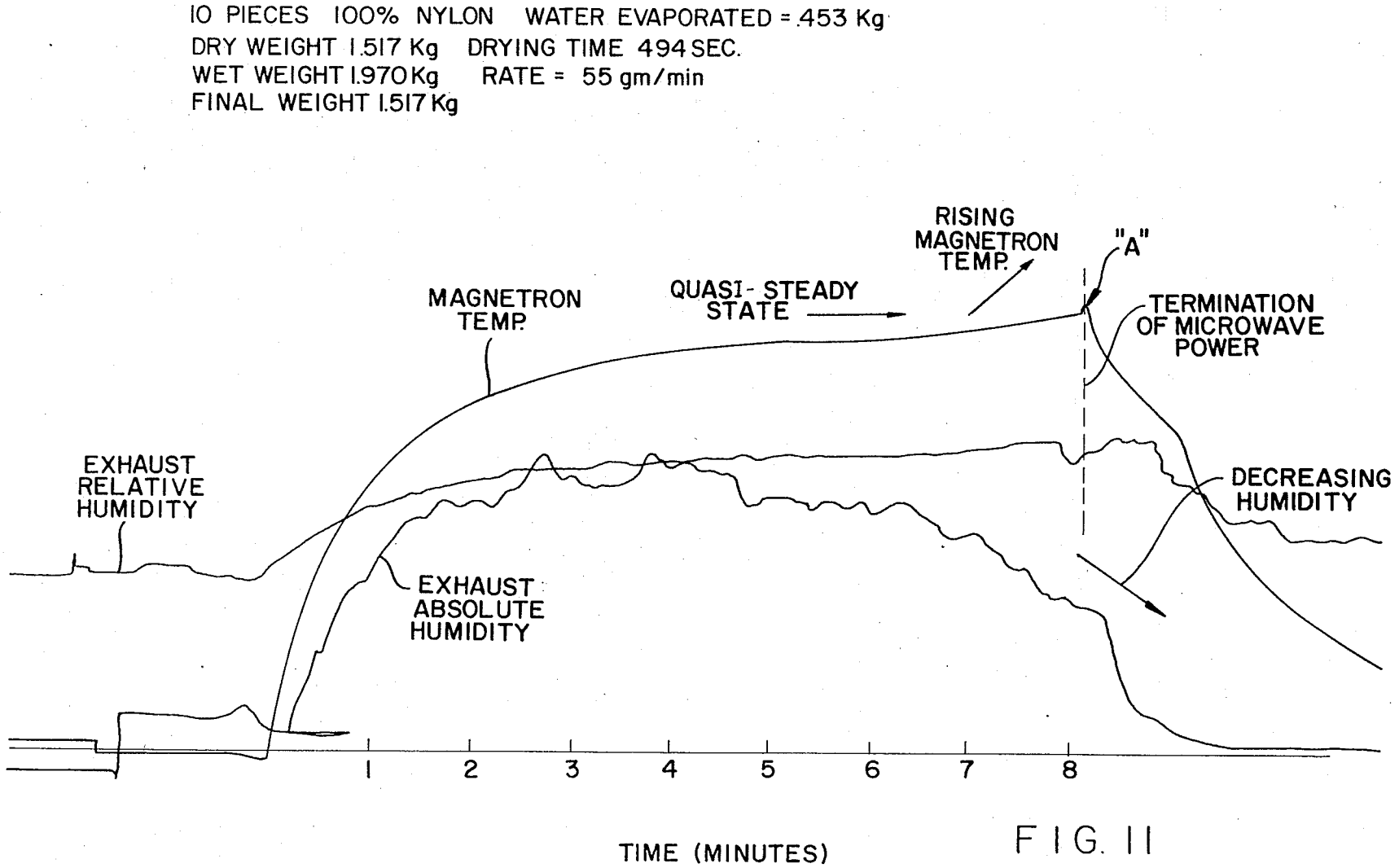
FIG. 11 shows a graph of magnetron anode temperature, exhaust relative humidity and exhaust absolute humidity versus time, during a drying cycle using the apparatus of FIG. 6.

The magnetron temperature gradually increases as the drying process progresses. The typical temperature of the magnetron at the end of the drying process is approximately 353° K. (80° C.). Sometimes a sharp increase "A" in magnetron temperature has been noticed towards the end of the drying process. An example of such a signal is shown in FIG. 11.

In addition, this temperature sensor 84 has been considered as a potential sensor for controlling output power of the magnetrons. As the drying process progresses there is an increasing mismatch between the load and magnetrons. Power reduction is desirable, therefore, to increase efficiency and to maintain low operating temperature of the magnetron. Lower operating temperature will also increase the magnetron lifetime expectancy. Most magnetrons are protected by a thermal cutoff switch that will shut down the magnetron power supply if the magnetron overheats. The application described above would perform a different function, that is to moderate the use of each magnetron to improve the efficiency of the process, i.e. reduce the power output of each magnetron relative to reflected microwave energies.

The beaded K type (chromel-alumel) thermocouple 83 is manufactured by Omega. The thermocouple is a voltage generating device where its output is proportional to the temperature of the junction. A noticeable increase in the outlet temperature at the end point has been observed during the drying process. The derivative of the temperature outlet curve indicates the sudden increase in the slope towards the end of the run. The evidence of the sharp increase in temperature at the end of the run indicates that this output parameter could be used to determine the end point of a drying process. Similarly the temperature indicated by the sensors in the air stream downstream from the magnetron show the same trend of increase in temperature at the end of the drying cycle.

A power reflection coefficient may also be used to represent the fraction of the power generated by the magnetron and directed down the waveguide toward the load that is reflected back toard the magnetron.

Table I below shows that at small load size, there is more reflection and load mismatch which causes the power output reduction of the magnetron and the increase of the average anode temperature. From the results, it was found that there is a relationship between the load match and the operating anode temperature of the magnetron. Using this unique relationship, it can be foreseen as one of the ways to determine the end point of the drying process or as a power control sensor during the drying process.

Table II below shows the relationship between the size and wetness of fabric loads and power reflection coefficients. The larger loads of 15 and 20 pieces of 100% cotton diapers have very small power reflection coefficients when wet, and moderate reflection coefficients when dry. The small load of only 5 diapers has a small reflection coefficient when wet, but a large reflection coefficient when dry. An empty chamber has a very large reflection coefficient.

Another method of detecting the load size and dryness condition in a microwave clothes dryer would be to provide instrumentation to directly measure the power reflection coefficient.

A way of implementing a power reflection coefficient measurement system would be to place a directional coupler in the waveguide between a magnetron and the cavity wall of the chamber. One sensor port of the directional coupler provides a small sample of microwave power proportional to the power directed from the magnetron toward the cavity wall. The other sensor port provides a small sample of the power travelling the opposite direction, that is reflected from the cavity wall toward the magnetron. Microwave power detectors, such as diodes, connected to these ports provide output signal voltages proportional to the microwave power at their respective ports. The ratio of these signal voltages is then equal to the power reflection coefficient and could be used by an electronic controller to manage the power application, detect the end of the drying cycle, or detect conditions requiring shut down such as an empty cavity. However, in multiple magnetron systems, placement of these couplers may pose a complication, wherein many usable fronts may pass across each couple and couplers may be competing for the same space with the tumbler mechanism. Therefore, the sensing of anode temperature is preferable as a method of sensing the dry condition of the fabric.

TABLE I

RELATIONSHIP BETWEEN POWER ABSORBED BY THE LOAD AND MAGNETRON ANODE TEMPERATURE

| wt. (kg) | time (sec) | anode temp.(c) | pow. out(watts) | PRC* |
|---|---|---|---|---|
| 1.021 | 300.255 | 70.00 | 657.13 | 0.036 |
| 1.750 | 300.235 | 73.00 | 683.31 | |
| 2.188 | 300.800 | 62.71 | 705.24 | 0.017 |
| 2.254 | 300.245 | 74.00 | 651.08 | |

PRC*power reflection coefficient at no load condition, the PRC = 0.935

TABLE 2

POWER REFLECTION COEFFICIENTS FOR FABRIC LOADS

| FABRICS | PRC DRY | PRC WET |
|---|---|---|
| 5 PIECES 100% CD | 0.857 | 0.052 |
| 15 PIECES 100% CD | 0.181 | 0.038 |
| 20 PIECES 100% CD | 0.2589 | 0.026 |

Having thus described the invention, with emphasis on fulfilling the objectives previously set forth, it is the intention to protect this invention by Letters Patent as presented by the subsequently appended claims.

What is claimed is:

1. A method of sensing the end point of a dry condition in a moist fabric disposed in a microwave heating and drying chamber, comprising the steps of:
   (a) substantially continuously measuring relative humidity at an outlet of said heating and drying chamber;
   (b) comparing the relative humidity at said outlet with a relative humidity reading at an inlet of said chamber; and
   (c) determining said end point of the dry condition when said outlet relative humidity falls to within a given percentage of said inlet reading.

2. The method of claim 1, wherein said given percentage is approximately 6%.

3. The method of claim 1, further comprising the step of:
   (d) controlling a power output of at least one microwave generator disposed about said chamber in response to the comparison of step (b).

4. A method of sensing the end point of a dry condition in moist fabric disposed in a microwave heating and drying chamber, comprising the steps of:
   (a) substantially continuously measuring absolute humidity output of said chamber;
   (b) comparing said absolute humidity output with a chosen baseline reading obtained at a start of the heating and drying of said fabric; and
   (c) determining said end point when said output reaches within a given value of said chosen baseline.

5. The method of claim 4, wherein said given value is approximately one millivolt above the baseline.

6. The method of claim 4, further comprising the step of:
   (d) controlling a power output of at least one microwave generator disposed about said chamber in response to the comparison of step (b).

7. A method of sensing the end point of a dry condition in moist fabric disposed in a microwave heating and drying chamber, comprising the steps of:
   (a) substantially continuously measuring anode temperature of at least one magnetron disposed about said chamber during a heating and drying cycle of said moist fabric;
   (b) sensing a sudden or sharp increase in said anode temperature; and
   (c) reducing or terminating power to at least said one magnetron in response to said increase of anode temperature in accordance with step (b).

8. The method of claim 7, further comprising the step of:
   (d) controlling a power output of at least two of said magnetrons in response to the increase in anode temperature.

9. The method of claim 7, further comprising the step of improving the uniformity of heating and drying of an article or articles of moist fabric being heated and dried by microwaves within said heating chamber, by (d) directing of multiple microwaves into said heating and drying chamber in a substantially non-interfering manner from at least two substantially oppositely planar positions disposed about said heating chamber, whereby said article or articles of moist fabric are more uniformly heated and dried.

10. The method of claim 9, wherein said directed microwaves from said two positions are cross-polarized with respect to each other.

11. The method of claim 10, wherein said directed microwaves from said at least two positions are generated independently by time-multiplexing, whereby simultaneous heating from said at least two positions does not occur.

12. The method of claim 9, wherein said directed microwaves from said at least two positions are generated independently by time-multiplexing, whereby simultaneous heating from said at least two positions does not occur.

13. The method of claim 12, wherein said microwaves are directed at said article or articles from two positions, with an angular focus between said two positions of less than 90 degrees.

14. The method of claim 10, wherein said microwaves are directed at said article or articles from two positions with an angular focus between said two positions of less than 90 degrees.

15. The method of claim 9, wherein said microwaves are directed at said article or articles from two positions with an angular focus between said two positions of less than 90 degrees.

16. The method of claim 9, wherein each microwave position has an angular spread of microwaves of approximately between 30 and 40 degrees as directed into said heating chamber.

17. The method of claim 10, wherein each microwave position has an angular spread of microwaves of approximately between 30 and 40 degrees as directed into said heating chamber.

18. The method of claim 12, wherein each microwave position has an angular spread of microwaves of approximately between 30 and 40 degrees as directed into said heating chamber.

19. The method of claim 13, wherein each microwave position has an angular spread of microwaves of approximately between 30 and 40 degrees as directed into said heating chamber.

20. An apparatus for substantially uniformly heating and drying an article or articles of moist fabric by microwaves, in accordance with the method of claim 9, comprising: a heating and drying chamber having at least two microwave generating means for generating microwaves from at least two substantially opposite planar positions disposed about said chamber, in a substantially non-interfering manner, said microwaves being directed into said heating chamber from said two positions for the heating and drying of said article or articles of moist fabric with substantial uniformity.

21. The apparatus of claim 20, wherein there are between two and six generating means for generating microwaves disposed about said heating chamber.

22. The apparatus of claim 20, wherein the generating means for generating said microwaves are arranged about said heating chamber such that said generated microwaves are cross-polarized with respect to each other.

23. The apparatus of claim 22, further comprising circuit means operatively connected to said generating means for time multiplexing said generating means, such that each generating means is powered independently whereby simultaneous heating from more than one generating means does not occur.

24. The apparatus of claim 20, further comprising circuit means operatively connected to said generating means for time multiplexing said generating means, such that each generating means is powered independently whereby simultaneous heating from more than one generating means does not occur.

25. The apparatus of claim 23, wherein certain ones of said generating means are angularly arranged about said heating chamber such that the microwaves are focused into said heating chamber with an angular focus of less than 90 degrees between said positions of said generating means.

26. The apparatus of claim 22, wherein certain ones of said generating means are angularly arranged about said heating chamber such that the microwaves are focused into said heating chamber with an angular focus of less than 90 degrees between said positions of said generating means.

27. The apparatus of claim 25, wherein each generating means generates microwaves having an angular spread of approximately between 30 and 40 degrees as directed into said heating chamber.

28. The apparatus of claim 23, wherein each generating means generates microwaves having an angular spread of approximately between 30 and 40 degrees as directed into said heating chamber.

29. The apparatus of claim 22, wherein each generating means generates microwaves having an angular spread of approximately between 30 and 40 degrees as directed into said heating chamber.

30. The apparatus of claim 20, wherein each generating means generates microwaves having an angular spread of approximately between 30 and 40 degrees as directed into said heating chamber.

31. The apparatus of claim 20, wherein said heating chamber is defined in a portion thereof by walls that form a conical-type configuration.

32. The apparatus of claim 20, wherein said heating chamber is defined in a portion thereof by walls that form a substantially pyramidal shape.

33. The apparatus of claim 23, wherein said circuit means includes at least one voltage doubler circuit.

34. The apparatus of claim 20, wherein said generating means includes a plurality of magnetrons each having a power output generally not exceeding 800 watts.

35. A microwave heating and drying chamber in accordance with the method of claim 7, having a plurality of microwave propagating sources having at least two sources of which provide substantially opposite planar propagation of microwaves, and a portion of which defines a substantially pyramidal configuration.

36. The microwave heating chamber of claim 35, having at least four microwave propagating sources.

37. A microwave heating and drying chamber in accordance with the method of claim 7, having a plurality of microwave propagating sources having at least two sources of which provide substantially opposite planar propagation of microwaves, and a portion of which defines a conical-type configuration.

* * * * *